United States Patent [19]

Inhofer, deceased et al.

[11] Patent Number: 5,002,238

[45] Date of Patent: Mar. 26, 1991

[54] LEVEL WIND CABLE GUIDE

[76] Inventors: Harold G. Inhofer, deceased, late of Hopkins; by Julie M. Inhofer, legal representative, 150 Central Ave. South, Wayzata, Minn. 55391; by William Inhofer, legal representative, 18125 N. 27th Pl., Plymouth, Minn. 55447

[21] Appl. No.: 467,206

[22] Filed: Jan. 19, 1990

[51] Int. Cl.[5] ..... B65H 57/00

[52] U.S. Cl. ..... 242/157.1; 242/157 R; 242/156.1

[58] Field of Search ..... 242/157.1, 157 R, 158 R, 242/156.1; 254/389

[56] References Cited

FOREIGN PATENT DOCUMENTS 239809 7/1962 Australia ..... 242/157.1

*Primary Examiner*—Stanley N. Gilreath

[57] ABSTRACT

A guide for controlling and insuring level wind of cables onto winch reels particularly when there is no load on the cable. The guide unit consists of a spring loaded, arcuately shaped bar to provide pressure against the incoming cable entirely across the width of the winch reel. The guide includes a base plate for mounting in close proximity to the reel, a spring biasing member which is retained to the base plate and which is designed, through a pair of extending arms to exert pressure upon an arcuately formed cable contacting member. The combination of the spring force and the arcuately formed member applies a pressure to the incoming cable such that it will be properly spirally wound about the cable reel and to particularly prevent the reel from climbing the outermost dimensions of the reel. In this manner then the cable is properly spirally wound about the reel with a single layer of cable being applied onto the reel in successive relation. The aspect of providing constant contact and pressure against the cable is only required under no load conditions as when the cable is under load conditions it will properly be received onto the cable in the desired spiral layered arrangement.

9 Claims, 2 Drawing Sheets

LEVEL WIND CABLE GUIDE

FIELD OF THE INVENTION

This invention relates generally to winch and cable equipment and more particularly to a device that will insure level winding of the cable onto the winch reel and not allow accumulation of the cable at the end of any cable layer.

SHORT SUMMARY OF THE INVENTION

A device for insuring level cable winding about the spool or reel of a winch particularly when the cable is under no load conditions.

The unit basically includes a first mounting plate which extends parallely to the axis of the reel and a biasing member-cable contacting combination mounted onto the base plate to maintain contact with the cable along its entire windup length to insure level winding of the cable. The biasing member includes a longitudinally extending coil spring mounted on a retainer with biasing arms at each end thereof which ends are defined to lie within the normal flange length of the reel and to exert pressure at each end of an arcuately shaped cable contacting bar which exerts the required pressure to the cable during no load take up. The spring mounting and arcuate bar combination provides an oscillatory movement to the bar such that it will maintain proper windup pressure against the cable. The unit further includes a cable throat area defined between the arcuate bar and a second bar mounted parallel therewith and normally underlying the cable. The two aforementioned bars are connected through a universal yoke which rests upon and is pivotally associated with the outermost circumference of the spring biasing member. The spring biasing member is mounted at a single point to the mounting plate to allow required movement of the cable contacting, arcuately shaped bar.

In this manner a pressure is applied to the cable along its entire windup dimension to insure that there will be no buildup of cable at the flange ends of the takeup reel as normally occurs when no windup pressure is provided onto a cable and which thereby insures successive layers of cable being taken onto the reel as desired.

BACKGROUND AND OBJECTS OF THE INVENTION

Applicant has found that in utilization of winches and cables, if a load is placed upon the cable during rewinding thereof the cable is controllable and will be level wound. If the cable is under a no load condition, then the cable will not level wind and winding will particularly stall at the end of any wound layer so as to accumulate or climb at the end of any such layer and not properly return for a next smooth layer across the reel. With the applicant's device a constant pressure is applied against the cable such that at the end of any one layer wind, the cable is properly directed back across the reel in a level manner and not allowed to "climb" in a corner.

In addition to insuring this directional movement applicant's device also insures proper cable and drum contact or wound layer contact under such no load cable conditions. If cable is wound without pressure it will not wind tightly about the roll or spool. If the cable is not tightly wound on the spool it presents a situation for damage of the cable and snarling or tangling of the same about the reel or spool.

It is therefore an object of the applicant's invention to provide a cable pressurizing unit for winding of cable onto reels or spools under no load conditions.

It is a further object of the applicant's invention to provide a cable pressurizing unit in operation and conjunction with a winch which includes a spring loaded, formed, cable contact bar to insure level winding of the no load cable upon the reel or spool.

These and other objects and advantages of the applicant's invention will more fully appear from a consideration of the accompanying disclosure made in association with the accompanying drawings.

Short Description Of The Drawings

Description Of A Preferred Form Of The Invention

Figure 1:
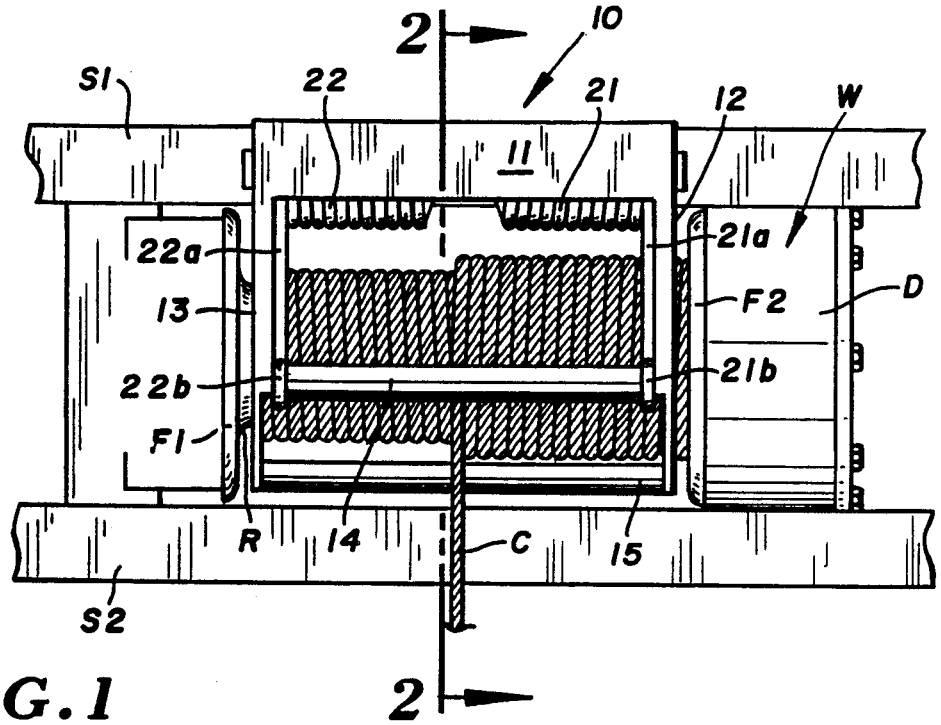
FIG. 1 is a top plan view of the level wind cable drive embodying the concepts of the application and illustrated in combination with a cable winch.
Figure 5:
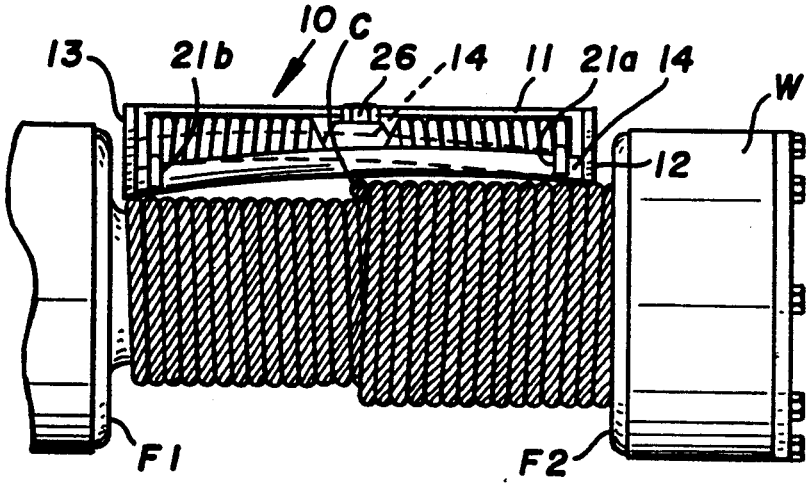
FIG. 5 is a front view taken substantially along line 5—5 of FIG. 2 and illustrating, by dotted lines and directive arrows the oscillatory effect of the formed cable guide bar; and, FIG. 6 is a perspective view of the unit which would be attached to a mounting bar which mounting bar is positioned adjacent the winch.
Figure 6:
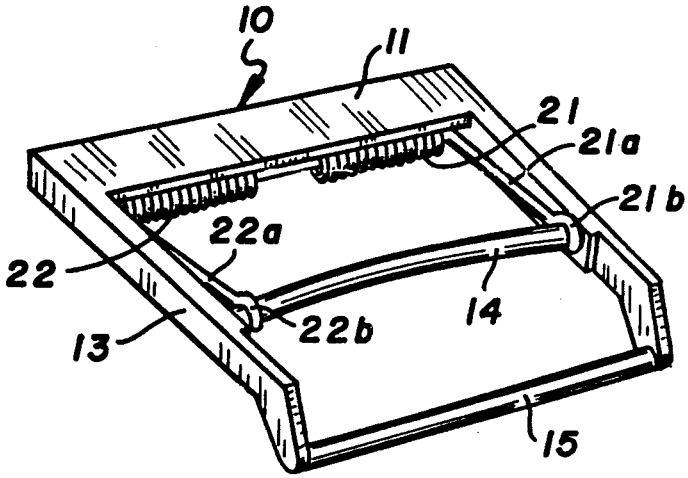

As illustrated in the accompanying drawings applicant's invention basically consists of an attachment to a winch and associated cable, the entire device being generally designated 10 with the winch being designated W and the cable C. The winch W includes a take up reel R having end flanges F1, F2 and means for driving the same. As illustrated in FIG. 1 support means S1, S2 are normally provided for mounting of the winch W to some other support unit such as a vehicle or the like. Applicant's invention 10 is designed as an attachment to such a structure and therefore the various support means may vary from application to application. The unit embodying applicant's invention which is attachable to such a winch is illustrated in perspective in FIG. 6 and a comparison of the FIGS. 1, 5 and 6 illustrates the normal mounting of the unit 10 in proper operative position to a winch W and the cable C. As illustrated in FIG. 6 the unit includes a main mounting leg 11, a pair of L shaped bars 12, 13 extending forwardly therefrom, a first particularly shaped cable contacting bar member 14 and a final cross and support member 15 extending between the aforementioned L-shaped legs 12, 13. This entire frame structure is then mounted to the support structures S1 and S2 of the particular application of the winch W.

Figure 3:
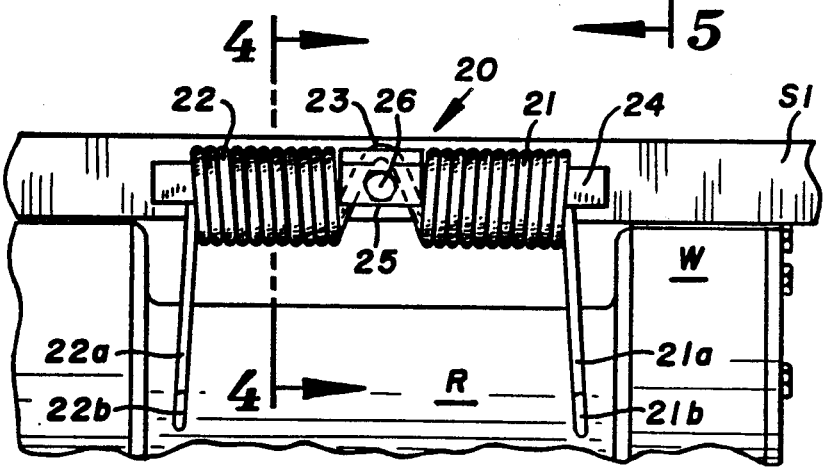
FIG. 3 is a horizontal section taken substantially along line 3—3 of FIG. 2.
Figure 4:
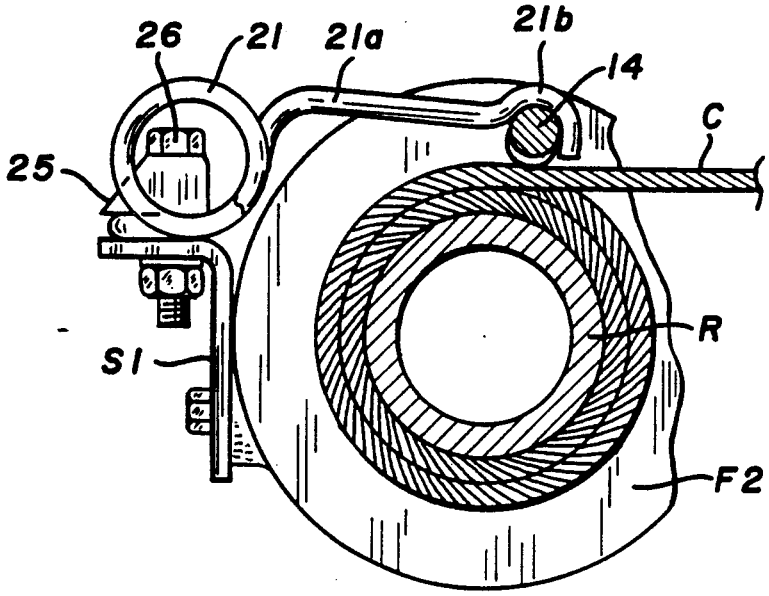
FIG. 4 is a vertical section taken substantially along line 4—4 of FIG. 3 and illustrating a portion of the take up reel and cable being wound onto the reel.

As illustrated in, particularly FIG. 3, a biasing member such as a coil spring 20 having oppositely wound helex areas 21, 22 longitudinally spaced from each other through an attachment connective V-shaped portion 23 of the wire forming the spring 20. Spring 20 is attached to support S1 through utilization of a spring retaining bar 24 which bar extends longitudinally through the spring sections 21, 22 and is provided with an intermediate boss 25 which lies between the spring sections 21,22 and over V-shaped area 23. It is through this attachment boss 25 that a fastening element 26 is provided to fasten the entire spring structure to one of the supports S1. In this manner then the spring 20 is positioned in proper respect to the reel-winch combination RW. The formed spring 20 also provides a pair of forwardly extending arms 21*a*, 22*a* having hook ends 21*b*, 22*b* thereon to engage the cable contacting rod 14.

Figure 2:
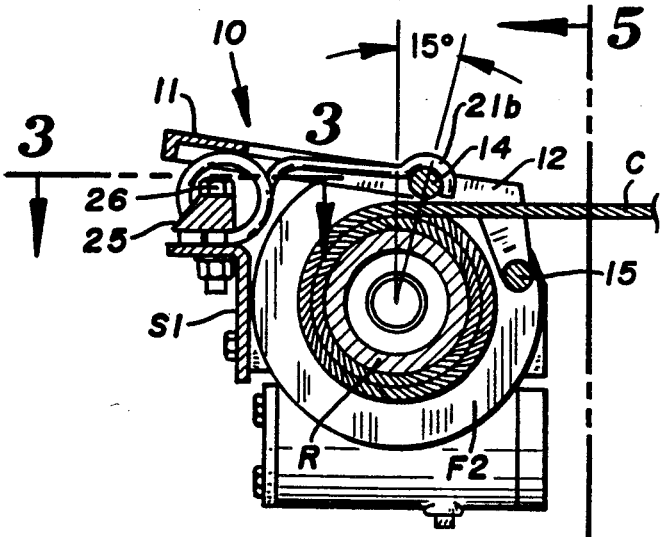
FIG. 2 is a vertical section taken substantially along line 2—2 of FIG. 1.

As particularly illustrated in FIG. 2 bar member 14 contacts the cable in advance of the point of contact of the cable with the drum or layers of cable on the drum. Through testing applicant has found that the contact point of bar member 14 with the cable should be in the range of 10 to 20 degrees circumferentially of the drum from the point of contact of the cable with the drum and that 15 degrees is suggested. Such particular location is important to the proper operation of the unit to provide proper lead in pressure to the cable.

As particularly illustrated in FIG. 2 the dimensions of the first longitudinally extending portion 11 of the unit 10 is of a dimension to normally ride and rest upon the outer circumference of the spring areas 21,22. This structure provides a moving fulcrum for the pressure applying unit 10 as the diameter of the reel R increases due to cable take up. In this same consideration it should be obvious that the free moveability of the entire framework consisting of the cross members 11, 14 and 15 and the L-shaped legs 12, 13 will be such that the rod 14 is maintained at its 15 degree location with respect to the reel. It should also be obvious that the rod 15 is positioned, due to the lengths of the legs 12, 13 forward of the wound cable C and does not contact the wound cable. It may be interpreted that the rod 14, rod 15 and lower ends of the legs 12, 13 provides a throat opening through which the cable C passes.

As illustrated in the drawings the cable contacting bar 14 is provided with a particular curve. In order to determine this curvature, applicant has found that the center of such bar and the ends thereof should be displaced from one another no more than one-half the cable diameter. This is to say that the arc of bar 14 is determined in accordance with the diameter of a cable upon which it will operate and the chord measurement of the arc of bar 14 is no more than one-half of the cable diameter. It should be noted that, although bar 14 is illustrated as a rod, it is only essential that the cable contacting surface thereof be radiused.

Use of the single mounting aspect and the independent spring arms allows a certain rolling motion to the formed bar 14 and this motion is illustrated by the dotted lines of FIG. 5. The shape of bar 14, in cooperation with the spring loads at the end thereof, allow a certain oscillatory effect to the bar 14 which provides the constant pressure on the cable and which of particular import, is to prevent accumulation or layering of the cable upon itself at the end of any wound layer and induces the next layer to be wound in proper sequence to the preceding layer.

Obviously the key element of the applicant's invention is the curved cable contacting and guide bar 14 having a predetermined arc. This bar, in cooperation with the biasing spring combination, provides a biasing force at the end of such bar 14 to allow oscillatory or rolling motion to the bar and insure constant cable squeeze against each wound layer across the whole width of the reel of the winch.

It should be obvious that applicant's unit will provide proper layering of a "no-load" cable onto the reel of a winch and will insure that upon completion of one layer the cable will be directed to the next layer without allowing accumulation of the cable in or at the ends of such cable layer.

What is claimed is:

1. A cable contacting and pressure applying device to insure level layer upon level layer of cable being wound upon the reel of a winch when the cable is under a no load condition, the reel of the winch having longitudinally spaced, end flanges, the pressure applying device including:

a. cable contacting bar extending longitudinally with the cable reel of a winch;

b. support means for mounting said cable contacting bar in cable contacting position;

c. biasing means urging said bar into cable contacting position to apply pressure to the cable as the same is spirally wound onto the reel; and d. said bar being rigid and being arcuately formed from one end thereof to the other end thereof.

2. The structure set forth in claim 1 wherein the arcuate curvature of said bar is determined by the chord length thereof being equal to one-half of the diameter of the cable carried by the reel.

3. The structure set forth in claim 1 and said biasing means including a spirally wound spring wherein said spring provides a pair of wound ends with one end being wound oppositely of the other end.

4. The structure set forth in claim 3 and said biasing means including a mounting area between said spring ends and means for attaching said spring at said mounting area to said support means.

5. The structure set forth in claim 4 and each of said spring ends providing a bar contacting arm respectively engaging each end of said cable contacting bar.

6. The structure set forth in claim 5 and a spring retaining bar arranged through said spring, a central boss area of said spring retaining bar engaging said mounting area of said spring for attachment thereof to said support means.

7. The structure set forth in claim 1 and said means for mounting said cable contacting bar including means for mounting said bar in advance of the point of contact of the cable with the drum or layers of cable on the drum.

8. The structure set forth in claim 7 and said bar being located in an angularly advanced position circumferentially of the drum from the point of contact of the cable with the drum in the range of 10 to 20 degrees.

9. The structure set forth in claim 8 and said angularly advanced position being 15 degrees.

* * * * *